US006048007A

United States Patent [19]

Shor

[11] Patent Number: 6,048,007

[45] Date of Patent: Apr. 11, 2000

[54] LEVER HANDLE DOOR LOCK WITH ADAPTER

[75] Inventor: Ilya Shor, Brooklyn, N.Y.

[73] Assignee: Arrow Lock Manufacturing Company, Brooklyn, N.Y.

[21] Appl. No.: 09/162,640

[22] Filed: Sep. 28, 1998

[51] Int. Cl.[7] ..... E05B 3/00

[52] U.S. Cl. ..... 292/348; 292/336.3; 292/357

[58] Field of Search ..... 292/336.3, 357, 292/348, DIG. 53, 60, 358, 353, 349; 70/451, 452, 450, 461, 224, 466; 403/97, 84

[56] References Cited

U.S. PATENT DOCUMENTS

| | | | |
|---|---|---|---|
| 2,163,101 | 6/1939 | Newton | 292/348 |
| 3,126,191 | 3/1964 | Holden | 403/97 |
| 3,277,601 | 10/1966 | Ryan | 403/97 |
| 4,619,540 | 10/1986 | Day et al. | 403/97 |
| 4,728,133 | 3/1988 | Valley | 292/357 |
| 4,869,083 | 9/1989 | DeMarseilles et al. | 292/357 |
| 4,921,289 | 5/1990 | Shen | 292/336.3 |
| 4,998,760 | 3/1991 | Nixon et al. | 292/336.3 |
| 5,118,152 | 6/1992 | Lin . | |
| 5,177,987 | 1/1993 | Shen . | |
| 5,481,890 | 1/1996 | Millman | 292/357 |
| 5,564,296 | 10/1996 | Theriault et al. . | |
| 5,605,064 | 2/1997 | Katayama et al. . | |
| 5,666,833 | 9/1997 | Gao et al. . | |
| 5,732,578 | 3/1998 | Kang . | |
| 5,761,936 | 6/1998 | Katayama . | |

*Primary Examiner*—Teri Pham
*Attorney, Agent, or Firm*—DeLio & Peterson, LLC

[57] ABSTRACT

A lever handle door lock keeps the lever handle horizontal and accommodates pre-manufactured doors with pre-drilled mounting holes at varying rotational orientations by providing a two piece adapter connection between the lever handle and a rose. The rose is mounted to the door via the mounting holes and includes a spring for returning the lever handle to horizontal. A first adapter piece is rotatably driven by the spring to return to a home position relative to the rose. A second adapter piece is connected to the lever handle and is adjustably connectable to the first adapter piece at different desired rotational orientations. Rotating the adjustable connection between the first and second adapter pieces changes the angle between the lever handle and the home position on the rose to bring the lever handle to horizontal regardless of the rotational orientation of the rose.

12 Claims, 2 Drawing Sheets

LEVER HANDLE DOOR LOCK WITH ADAPTER

BACKGROUND OF THE INVENTION

1. Field of the Invention

This invention relates to cylinder locks having a lever handle. More specifically, this invention relates to lever handle cylinder locks wherein the lever handle is returned to horizontal by a spring located within a rose which can be mounted to a door at different orientations relative to the horizontal.

2. Description of Related Art

Lever handle locks are conventionally mounted with the lever handle positioned horizontally. This orientation requires that the offset weight of the lever portion of the handle be supported against the force of gravity, and such support normally is provided by a spring that is in addition to the springs commonly used in cylindrical locks to extend the latch. The lever handle support spring is most often located in the rose which is mounted to the face of the door.

The rose surrounds the base of the handle, is generally circular, and covers the opening in the door containing the cylindrical lock mechanism. It is typically held to the door and prevented from rotating by a secure mount or connection to the door. The mounting system most commonly includes mounting holes which extend through the door and studs on the rose which extend into the mounting holes to prevent the rose from rotating. The strength and security of the mounting system is particularly important in resisting vandalism, damage to the lock and unauthorized entry in view of the relatively high leverage that can be applied to a cylinder door lock with a lever handle.

Occasionally, the mounting holes are drilled through the door by the installer, but more often, and particularly for steel doors and other pre-manufactured doors, the mounting holes are provided by the door manufacturer. The mounting holes provided by the manufacturer are often located directly above and below the centerline of the bored opening for receiving the cylindrical lock, however, they may also be provided at various other angular orientations relative to horizontal.

Because the lever handle support spring in the rose returns the lever handle to a fixed location relative to the rose, the varying rotational orientation of the mounting holes for the rose will affect the horizontal position of the handle if a means is not provided to compensate for the various different rotational orientations of the mounting holes.

Heretofore, this compensation for varying mounting hole positions has been provided by allowing the mounting studs on the rose to be moved relative to the rose such that the rose is always mounted to the door in the same rotational orientation. This holds the spring centering mechanism in the rose horizontally, and thereby keeps the handle horizontal. Typically, the studs are threaded and may be moved to various positions around the perimeter of the rose to adjust the rose so that it is always horizontal, regardless of the position of the mounting holes. Other methods of adjusting the rotational orientation of the rose have also been tried.

One difficulty with these methods is the number of the pieces which must be repositioned into the correct orientation on the rose prior to installation. These pieces may be lost or one or more of them may be installed incorrectly.

A related problem is the time necessary to unthread and reinstall the pieces and the necessity for a wrench, pliers, or other tool to uninstall and reinstall the mounting studs.

Another difficulty is the relative weakness of the system when the pieces must be constructed with threads or other elements allowing them to be removed for repositioning. These components are important in preventing the locks from being damaged by the use of excess force on the lever arm provided on the lever handle, and weakness at this point compromises lock security.

Bearing in mind the problems and deficiencies of the prior art, it is therefore an object of the present invention to provide a lever handle door lock which is relatively easy to adjust for different mounting orientations without the necessity of tools.

Another object of the invention is to provide a lever handle door lock which has strong mounts between the rose and the door.

Yet another object is to provide a lever handle door lock in which the connection between the lever handle and the rose may be adjusted to allow the rose to be mounted to a door at different rotational mounting orientations to match the mounting holes on the door while allowing adjustment of the orientation of the handle back to horizontal.

Still other objects and advantages of the invention will in part be obvious and will in part be apparent from the specification.

SUMMARY OF THE INVENTION

The present invention addresses the need for improvement in this field by providing a door lock including a lever handle, a rose having a spring, and a mount for mounting the rose to a door at different angular mounting orientations relative to horizontal. A first adapter piece is rotatably driven by the spring for return to a defined rotational orientation relative to the rose (the home position) and a second adapter piece is connected to the lever handle and to the first adapter piece. The connection between the first and second adapter pieces is rotationally adjustable to different desired rotational orientations. This rotational adjustment allows the lever handle to be brought to a horizontal orientation regardless of the rotational orientation of the rose or the mounting holes with which the rose is attached to the door.

In one embodiment of the invention the first adapter piece includes a plurality of notches and the second adapter piece includes at least one lug projecting into a selected one of the plurality of notches in the first adapter piece. The lug is repositionable in different notches to make the rotational adjustment between the second adapter piece and the first adapter piece. Preferably, there are at least three notches in the first adapter piece to receive the lug allowing three different orientations for the handle to accommodate three different conventional mounting hole orientations.

In the most highly preferred aspect of the invention, the second adapter piece includes a plurality of equally spaced lugs corresponding to a plurality of equally spaced notches on the first adapter piece, the plurality of lugs being selectably repositionable in the plurality of notches.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE PREFERRED EMBODIMENT(S)

Figure 1:
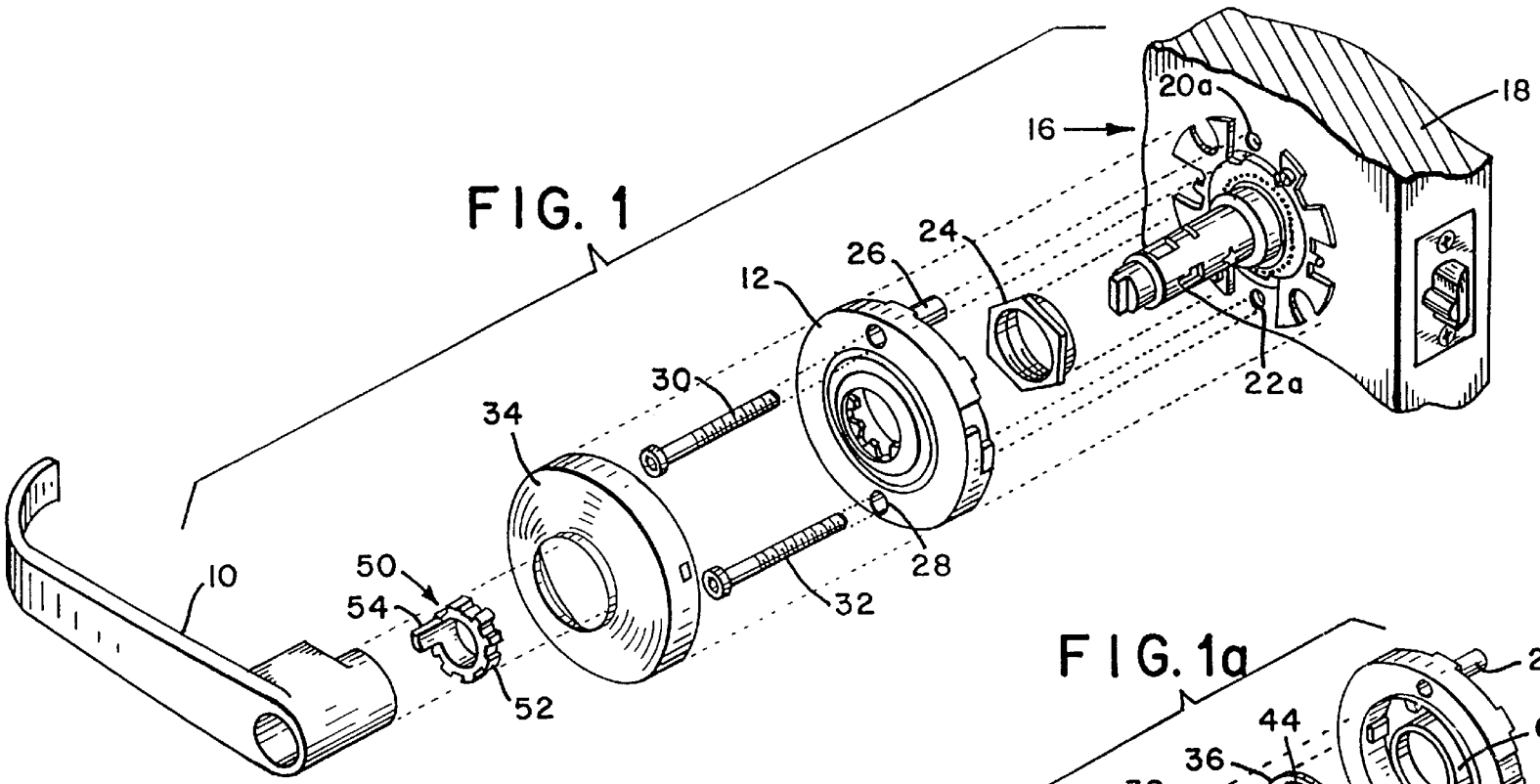
FIG. 1 is an exploded perspective view of the preferred embodiment of the invention, including an assembled view of the rose used in this invention.

In describing the preferred embodiment of the present invention, reference will be made herein to FIGS. 1–2 of the drawings in which like numerals refer to like features of the invention. Features of the invention are not necessarily shown to scale in the drawings.

Referring to FIG. 1, a door lock according to the present invention includes a lever handle 10, a rose 12 and a substantially conventional cylindrical lock mechanism 16 installed in a door 18. Door 18 has a pair of mounting holes 20*a*, 22*a* vertically positioned relative to the center line of the cylindrical lock 16.

Nut 24 conventionally holds a cylindrical lock mechanism 16 in the door 18, and a pair of hollow studs 26, 28 extend into the mounting holes 20*a*, 22*a* respectively to prevent the rose 12 from rotating relative to the door. Bolts 30, 32 extend through the hollow studs 26, 28 and into corresponding threaded studs in the opposite rose or into a threaded portion of the rose on the opposite side (not shown). A scalp 34 is used to conceal the rose and provide a decorative appearance for the rose.

Figure 1A:
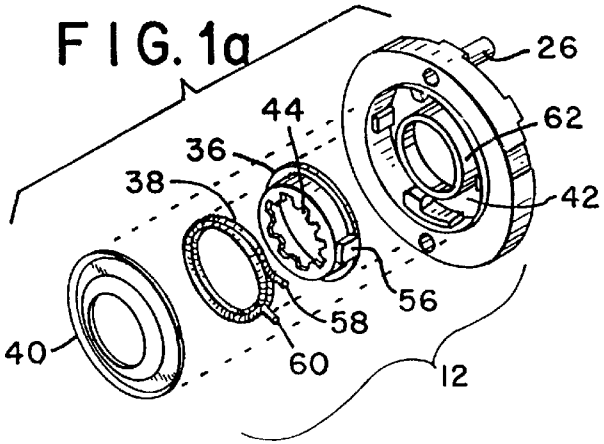
FIG. 1*a* shows an exploded perspective view of the rose used in this invention which is shown fully assembled in FIG. 1.

FIG. 1*a* provides an exploded view of rose 12 seen fully assembled in FIG. 1. The rose 12 includes a first adapter piece 36, spring 38 and spring cover 40 which holds the first adapter piece 36 and spring 38 in a channel 42 in the rose 12. The first adapter piece 36 is substantially ring shaped and includes an outer surface which rotates in the channel 42 and an inner surface having a plurality of notches 44 substantially equally spaced around the inner surface.

Referring to FIG. 1, a second adapter piece 50 is provided having a plurality of substantially equally spaced lugs 52 arranged around its outer surface. The lugs on second adapter piece 50 provide a mating engagement with the notches on the inner surface of first adapter piece 36 and allow the second adapter piece 50 to be removed and incrementally rotated by one or more notches to adjust the rotational orientation of projection 54 on the second adapter piece 50 relative to finger 56 on the first adapter piece.

The finger 56 on the adapter piece 36 extends between two upturned ends 58, 60 on spring 38. When spring 38 and adapter piece 36 are in their home positions, the finger 56 is aligned with a projection 62 on the inside of channel 42, and upturned ends 58, 60 on the spring lie on the opposite sides of projection 62. Rotation of the first adapter piece 36 in either direction causes finger 56 to contact one of the upturned ends 58, 60 while the other upturned end remains trapped against projection 62. As soon as the rotational force is released, spring 38 returns the first adapter piece 36 to the home position bringing finger 56 into alignment with projection 62.

When the door lock is assembled, and the second adapter piece 50 is engaged in the interior of the first adapter piece 36, projection 54 extends into a corresponding opening in the interior handle 10, making a secure and nonrotatable connection between the second adapter piece 50 and the handle 10.

It can be seen from this description that the position of projection 54 controls the orientation of the handle 10, while the position of finger 56 controls the home location of the spring.

Figure 2:
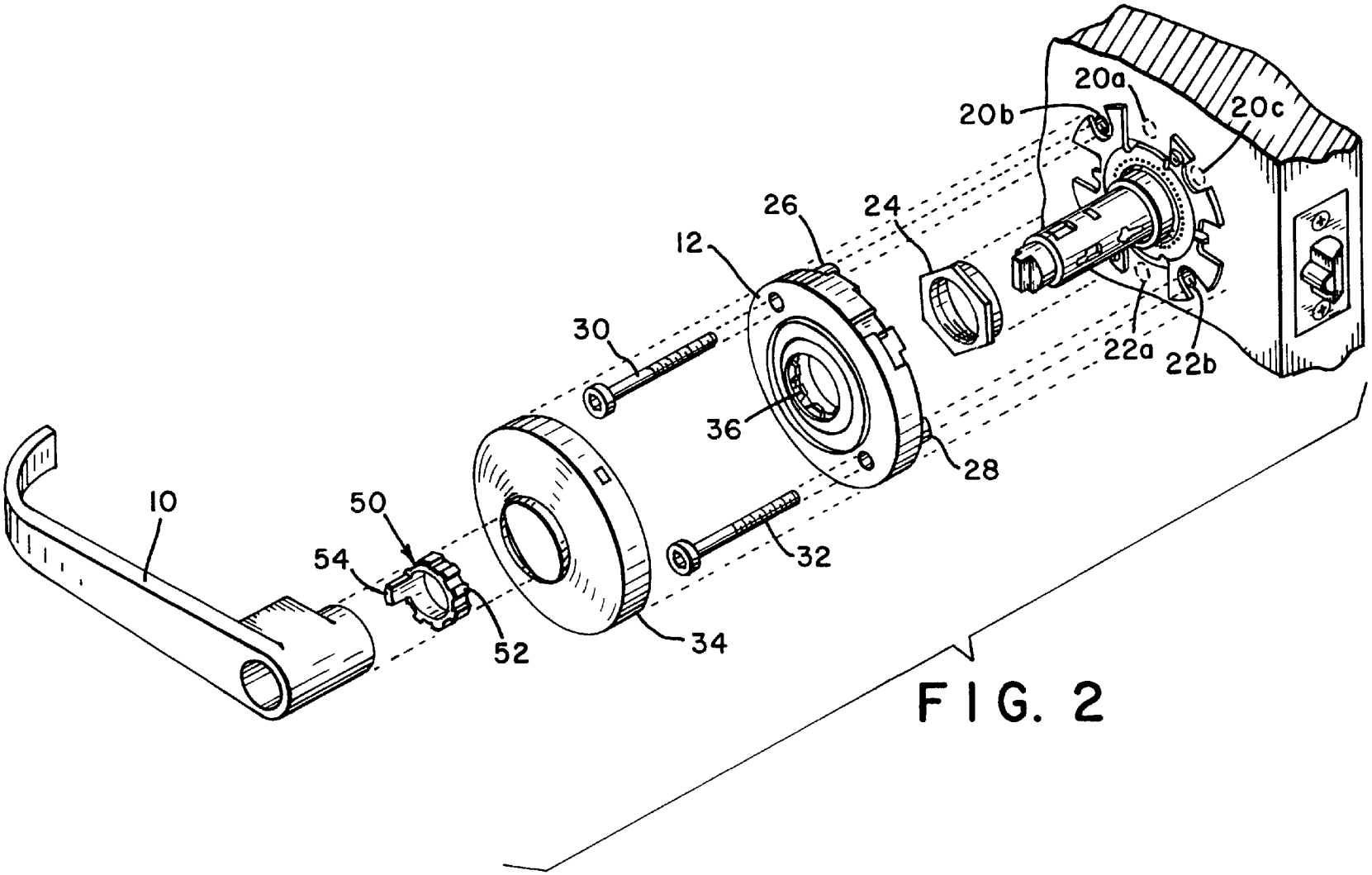
FIG. 2 is an exploded perspective view of the preferred embodiment of the invention as seen in FIG. 1, except that the invention is shown ready for attachment to a door having mounting holes at a different rotational orientation from the door shown in FIG. 1. Other possible mounting holes locations which may be provided by a door manufacturer are shown with dashed lines.

Referring to FIG. 2 it can be seen that mounting holes 20*b*, 22*b* are located at a different rotational orientation than mounting holes 20*a* and 22*a* in FIG. 1. Consequently, the mount for rose 12, comprising mounting studs 26, 28 is in a different rotational orientation than the mount for rose 12 seen in FIG. 1. This rotates the location of the projection 42 and correspondingly changes the home position for finger 56. In prior art designs, this rotational change in the location of the home position would have changed the angular orientation of the handle, tilting it away from level.

Thus, prior art designs required that the home position on the rose, and the rose itself, always be installed in the same position regardless of the rotational orientation of the mounting holes on the door. This required that the rose allow the mounting studs to be repositioned relative to the rose so that the home position could remain unchanged. However, in the present invention the rose 12 is rotated to match the rotational orientation of the mounting holes on the door and the position of the handle 10 is returned to horizontal by repositioning the second adapter piece 50 relative to the first adapter piece 36.

This repositioning is accomplished simply by removing the second adapter piece 50 and rotating it by one or more notches and re-engaging it with the interior of the first adapter piece 36. This shifts each lug 52 into a new notch 44 and returns the projection 54 to a horizontal orientation, despite the non-horizontal orientation of the home position set by finger 56 and projection 62.

FIG. 2 also illustrates other possible locations for mounting holes 20*a* and 20*c* which are spaced by approximately 45° increments. Preferably the lugs and notches are provided with sufficiently fine spacing to allow the most common conventional mounting locations of vertical and 45° to either side of vertical to be accommodated evenly.

In the most highly preferred design, the notches and lugs are approximately the same width, the notches extend around the entire inner surface of the first adapter piece 36, and the lugs extend around the entire outer surface of the second adapter piece 50. However, it is also possible to change the width of the notches and lugs or to use only a single lug and a limited selection of appropriately positioned notches allowing the desired repositioning. The lugs may be on the first adapter piece or on the second adapter piece, or they may take the form of cogs or splines or other connection methods. Preferably a strong connection method between the two adapter pieces should be used, as shown, because this connection takes relatively high loads during use and during attempts to force the lock.

Although the preferred embodiment uses lugs and notches, the invention contemplates other rotatably adjustable connections between the first and second adapter pieces, including adjustments which are continuous to accommodate all possible orientations.

It also should be noted that the adjustable nature of this invention allows the handle to be positioned at any desired location. For example, the handle may be installed pointing up or down or projecting forward where desired for a specialty application.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A door lock comprising:

a lever handle;

a rose including:

a spring, and a mount for mounting the rose to a door at different angular mounting orientations relative to horizontal;

a first adapter piece rotatably driven by the spring for return to a defined rotational orientation relative to the rose; and a second adapter piece connected to the lever handle and to the first adapter piece, the second adapter piece being adjustably connected to the first adapter piece for adjustment to different desired selected rotational orientations to hold the lever handle in a horizontal orientation at each different angular mounting orientation of the rose and the lever handle being removably connected to the second adapter piece.

2. The door lock of claim 1 wherein the first adapter piece includes a plurality of notches and the second adapter piece includes at least one lug projecting into a selected one of the plurality of notches in the first adapter piece, the lug being repositionable in different ones of the plurality of notches to adjustably connect the second adapter piece to the first adapter piece at different desired rotational orientations.

3. The door lock of claim 2 wherein the plurality of notches includes at least three notches.

4. The door lock of claim 2 wherein the second adapter piece includes a plurality of lugs corresponding to the plurality of notches on the first adapter piece, the plurality of lugs being selectably repositionable in the plurality of notches.

5. The door lock of claim 2 wherein the plurality of notches on the first adapter piece are oriented at predefined angular orientations corresponding to a plurality of conventional different angular mounting holes on doors.

6. The door lock of claim 1 wherein the second adapter piece includes a projection connecting the second adapter piece to the lever handle.

7. The door lock of claim 1 wherein the mount on the rose comprises a pair of studs.

8. The door lock of claim 7 wherein the studs are hollow.

9. The door lock of claim 1 wherein the second adapter piece is adjustably connectable to the first adapter piece with at least three different rotational orientations, each rotational orientation being offset from each adjacent orientation by about forty-five degrees.

10. The door lock of claim 1 wherein the spring includes two upturned ends and the first adapter piece includes a finger projecting between the two upturned ends of the spring.

11. The door lock of claim 1 wherein:

the first adapter piece is ring-shaped, having an inner surface and an outer surface, the outer surface being rotatably held by the rose and the inner surface including a plurality of substantially equally spaced notches; and the second adapter piece fits within the first adapter piece, the second adapter piece having:

an outer surface with a plurality of substantially equally spaced lugs in mating engagement with the plurality of notches in the inner surface of the first adapter piece, and a projection non-rotatably connecting the second adapter piece to the lever handle.

12. The door lock of claim 11 wherein the lugs and the notches are of approximately the same width.

* * * * *